US005334041A

United States Patent [19]

Anbo et al.

[11] Patent Number: 5,334,041

[45] Date of Patent: Aug. 2, 1994

[54] DEVICE FOR DETACHABLY COUPLING FIRST AND SECOND HALVES OF ELECTRIC CONNECTOR

[75] Inventors: Tsugio Anbo, Tokorozawa; Yukihumi Machida, Urayasu; Hirohumi Iguchi, Tokyo, all of Japan

[73] Assignee: Mitsubishi Cable Industries Ltd., Amagasaki, Japan

[21] Appl. No.: 21,083

[22] Filed: Feb. 23, 1993

[30] Foreign Application Priority Data

Feb. 26, 1992 [JP] Japan ..... 4-075377

[51] Int. Cl.[5] ..... H01R 13/627

[52] U.S. Cl. ..... 439/358; 439/682; 439/357

[58] Field of Search ..... 439/350, 351, 353, 354, 439/357, 358, 404, 682

[56] References Cited

U.S. PATENT DOCUMENTS

| | | | |
|---|---|---|---|
| 2,980,881 | 4/1961 | McKee | 439/682 |
| 4,089,580 | 5/1978 | Huffnagle et al. | 439/404 |
| 4,113,179 | 9/1978 | McKee | 439/354 |
| 4,961,711 | 10/1990 | Fujiura et al. | 439/357 |
| 5,178,556 | 1/1993 | Chen | 439/357 |

FOREIGN PATENT DOCUMENTS

| | | | |
|---|---|---|---|
| 0446467 | 9/1991 | European Pat. Off. | 439/357 |
| 3159078 | 7/1991 | Japan . | |
| 4220974 | 8/1992 | Japan . | |

*Primary Examiner*—Gary F. Paumen
*Assistant Examiner*—Hien D. Vu
*Attorney, Agent, or Firm*—Varndell Legal Group

[57] ABSTRACT

An electric connector including a first connector half having a plurality of terminals, a second connector half having a plurality of corresponding terminal and a pair of leaf springs secured to opposite side also of the first connector half for detachably coupling he first and second connector halves with each other. Each leaf spring includes a fitting portion, a bent portion, an unlocking portion, an intermediate portion, an end portion with a locking aperture, and a reinforcing portion having one end connected to a junction between the bent portion and the unlocking portion. The fitting portion is secured to the first connector half and an end of the reinforcing portion is urged against a side wall of the first connector half. When the second connector half is inserted into the first connector half, a locking projection formed on a side wall of the second connector half engages with the locking aperture for locking the first and second connector halves together. When the unlocking portion of the leaf spring is pushed toward the side wall of the first connector half, locking projection is disengaged from the locking aperture to release the connector halves. The reinforcing portion increases the resiliency of the leaf spring for preventing accidental unlocking and insuring a positive displacement of the end portion when unlocking.

5 Claims, 2 Drawing Sheets

DEVICE FOR DETACHABLY COUPLING FIRST AND SECOND HALVES OF ELECTRIC CONNECTOR

BACKGROUND OF THE INVENTION

1. Field of the Invention

The present invention relates to a device for detachably coupling first and second connector halves of an electric connector, including a leaf spring having a fitting portion at one end of the leaf spring, by means of said fitting portion the leaf spring is secured to the first connector halves, a locking aperture into which a locking projection formed on a side wall of the second connector half is inserted to couple the first and second connector halves with each other by means of the leaf spring, and an unlocking portion, by pressing said unlocking portion toward a side wall of the first connector half, the leaf spring being deformed such that the locking aperture is removed from the locking projection to release a locking condition of the first and second connector halves.

2. Description of the Related Art

The above mentioned locking device is most conventionally used for a connector which is used in an environment subjected to a high temperature such as an engine room of an automobile. In this case, each of the first and second connector halves includes a housing made of plastics and the locking projection is integrally formed on the housing of the second connector half.

FIG. 1 is a cross sectional view showing a known connector locking device disclosed in Japanese Patent Application Laid-open Publication Toku Kai Hei 3-159078. In FIG. 1, a first connector half 1 and a second connector half 2 are coupled with each other to form an assembly and are locked in a given position by means of a locking leaf spring 3. It should be noted that FIG. 1 shows only a half of the assembly and a second locking leaf spring provided on an opposite side wall of the assembly is not shown. The locking leaf spring 3 is formed by punching out of a metal plate and is shaped into a desired configuration. The leaf spring 3 comprises a fitting portion 4 at its one end and a locking aperture 5 at the other end thereof. The fitting portion 4 is inserted into a recess formed in a housing of the first connector half 1. On a housing of the second connector half 2 there is formed a locking projection 6. In the coupled condition illustrated in FIG. 1, the locking projection 6 is inserted into the locking aperture 5 of the leaf spring 3, so that the first and second connector halves 1 and 2 are locked by the engagement of the locking aperture 5 and locking projection 6. The leaf spring 3 further includes an intermediate portion 7 and an unlocking portion 8. When the unlocking portion 8 of the leaf spring 3 is pressed upward in FIG. 1, i.e. toward the side wall of the first connector half 1, the leaf spring is deformed as shown by a chain line and the locking projection 6 is removed from the locking aperture 5. That is to say, when the unlocking portion 8 of the leaf spring 3 is pressed toward the side wall of the first connector half 1, the intermediate portion 7 of the leaf spring 3 is urged against a fulcrum portion 9 formed in the housing of the first connector half 1, so that the end of the leaf spring 3 where the locking aperture 5 is formed is effectively moved away from the side wall of the housing of the second connector half 2. In this manner, a portion of the leaf spring 3 including the locking aperture 5, intermediate portion 7 and unlocking portion 8 serves as a lever.

As depicted in FIG. 1, the leaf spring 3 is bent over between the fitting portion 4 and the unlocking portion 8 by a substantially 360 degrees to form a bent portion 10, so that the bent portion is subjected to a large stress. When the unlocking portion 8 of the leaf spring 3 is pressed toward the first connector half 1 in order to disengage the first and second connector halves 1 and 2 from each other, the bent portion 10 is further bent. Therefore, when the locking and unlocking operations is repeated, the mechanical strength of the bent portion 10 of the leaf spring 3 becomes weak. This results in that when the unlocking portion 8 is pressed, the unlocking portion itself is deformed largely and the end portion of the leaf spring 3 at which the locking aperture 5 is formed could not be displaced away from the second connector half 2 and thus the locking condition could not be released positively. Moreover, in the known connector locking device shown in FIG. 1, the unlocking portion 8 of the leaf spring 3 is exposed from the housing of the first connector half 1, so that the unlocking portion is liable to be pressed accidentally. Therefore, it is difficult to attain the positive locking function.

Another locking device is disclosed in Japanese Patent Application Laid-open Publication Toku Kai Hei 4-220974 (EUROPAISCHE PATENTANMELDUNG 446467 A1). The locking device also involves same problems as the above mentioned locking device.

SUMMARY OF THE INVENTION

The present invention has for its object to provide a novel and useful device for locking first and second connector halves, in which the above mentioned drawbacks of the known locking device can be removed efficiently and a possibility that the locking condition is accidentally released can be mitigated and the unlocking operation can be performed positively.

According to the invention, a device for detachably coupling first and second connector halves of an electric connector comprises a leaf spring having a fitting portion provided at one end of the leaf spring, said fitting portion being secured to the first connector half, a locking aperture provided at the other end of the leaf spring, into said locking aperture being inserted a locking projection formed on the second connector half to couple the first and second connector halves with each other by means of the leaf spring, a bent portion formed adjacent to said fitting portion, an unlocking portion formed adjacent to said bent portion, an intermediate portion formed between said locking aperture and said unlocking portion, said intermediate portion being urged against a fulcrum formed on said first connector half, and a reinforcing portion having one end connected to a junction between said bent portion and said unlocking portion and the other end urged against a side wall of the first connector half, whereby the leaf spring is formed such that when said unlocking portion is pressed toward the side wall of the first connector half, the leaf spring is resiliently deformed such that the locking aperture is removed from the locking projection to release the locking condition of the first and second connector halves.

In the connector locking device according to the invention, the leaf spring has the reinforcing portion formed integrally therewith at such position that the bent portion and unlocking portion are hardly deformed, so that the locking condition of the first and second connector halves can be positively maintained and the end portion of the leaf spring where the locking aperture is formed can be positively moved away from the side wall of the second connector half to release the locking condition effectively.

DESCRIPTION OF THE PREFERRED EMBODIMENT

Figure 1:
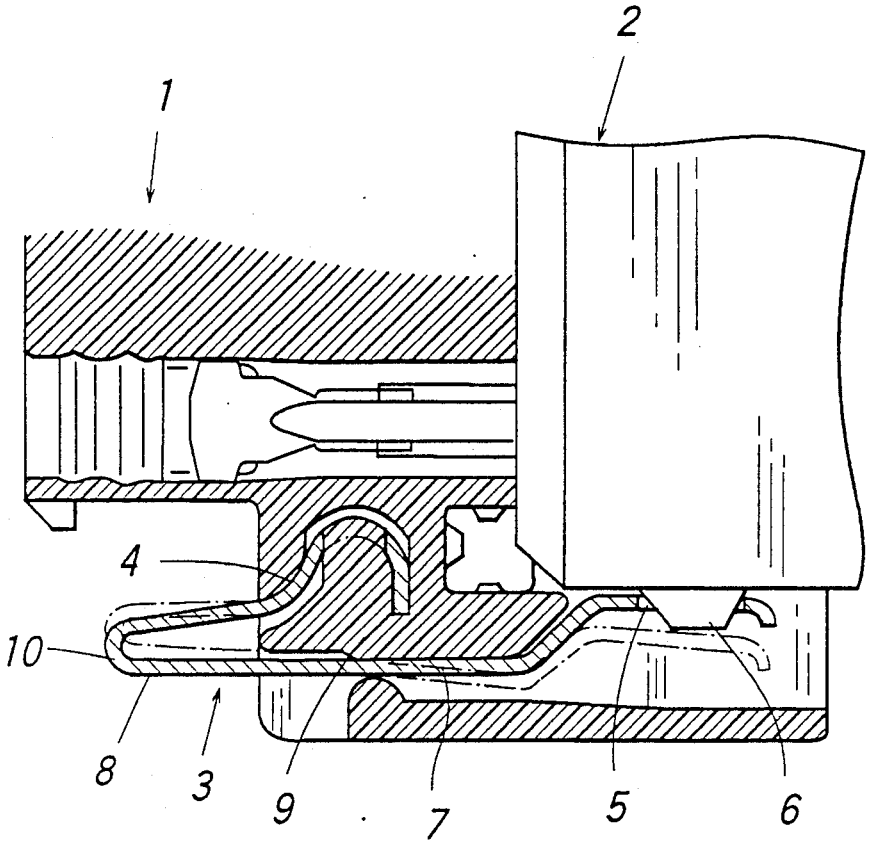
Prior Art Fig.1
FIG. 1 is a cross sectional view showing the known connector locking device.
Figure 2:
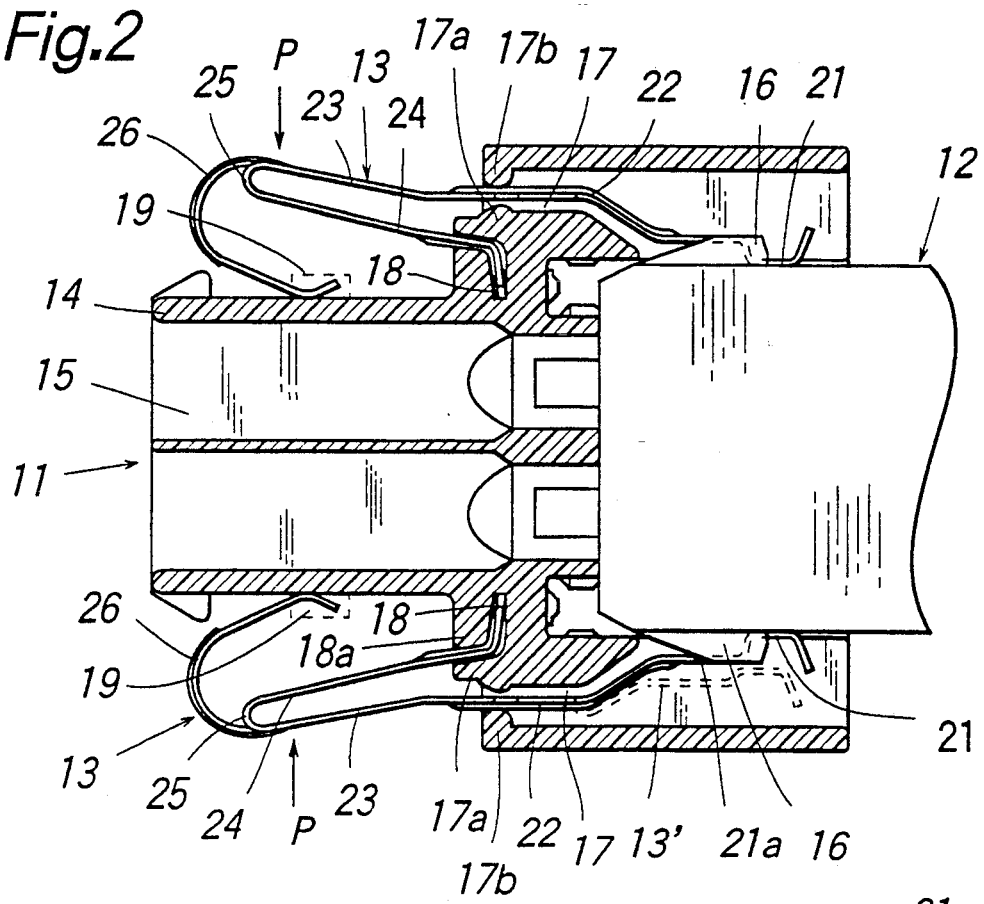
FIG. 2 is a cross sectional view illustrating an embodiment of the connector locking device according to the invention.

FIG. 2 is a cross sectional view showing an embodiment of the connector locking device according to the invention. In FIG. 2, a first connector half 11 and a second connector half 12 are coupled with each other and the coupling condition is locked by a pair of leaf springs 13 provided on opposite side walls of the connector halves. These leaf springs 13 have the same construction, so that only one of them will be explained hereinafter. Housings of the first and second connector halves 11 and 12 are formed by molding heat resistance synthetic resin such as nylon having reinforcing glass fibers. In the housing of the first connector half 11, there is formed a terminal containing tube-like member 14 in which a given number of terminals 15 connected to electric wires are arranged. Within the housing of the second connector half 12, there are arranged a corresponding number of terminals which may be inserted into the terminals 15.

Figure 3:
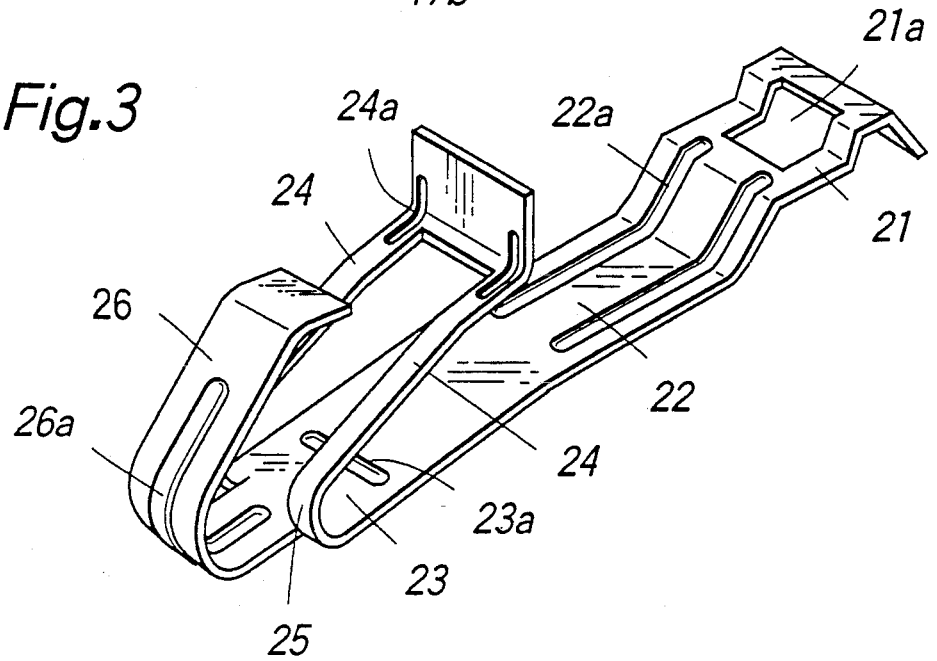
FIG. 3 is a perspective view depicting the leaf spring shown in FIG. 2.

FIG. 3 is a perspective view illustrating the construction of the leaf spring 13. The leaf spring 13 is punched out of a resilient metal plate and is shaped into a desired configuration. The leaf spring 13 includes an end portion 21 in which a locking aperture 21*a* is formed, an intermediate portion 22 extending from the end portion 21, an unlocking portion 23 extending from the intermediate portion 22, a fitting portion 24 connected to the unlocking portion 23 by means of a bent portion 25, and a reinforcing portion 26 having one end connected to a junction between the unlocking portion 23 and the bent portion 25. The reinforcing portion 26 is bent over. In order that the end portion 21 can easily ride over a locking projection or pin formed in the second connector half 12, the front end of the end portion 21 is slightly bent outwardly. Further a front end of the fitting portion 24 is bent inwardly by substantially 90 degrees. In the intermediate portion 22, unlocking portion 23, fitting portion 24 and reinforcing portion 26, there are formed ribs 22*a*, 23*a*, 24*a* and 26*a* for increasing the resilient force of the leaf spring 13.

On the side wall of the housing of the second connector half 12, there is formed a locking projection 16 for being inserted into the locking aperture 21*a*. In upper and lower surfaces of the housing of the first connector half 11, there are formed first and second recesses 17 and 18 for supporting the leaf spring 13. The first recess 17 has a substantially rectilinear configuration and the second recess 18 is formed in an L-shape. When the leaf spring 13 is inserted into the housing of the first connector half 11 from a direction perpendicular to the plane of the drawing of FIG. 2, the intermediate portion 22 of the leaf spring 13 is inserted into the first recess 17 and the fitting portion 24 is inserted into the second recess 18. During this inserting operation, the front end of the reinforcing portion 26 abuts a projection 19 formed on the side wall of the housing of the first connector half 11. Then, the front end of the reinforcing portion 26 is bent outwardly such that the front end of the reinforcing portion rides over the projection 19. Then, the front end of the reinforcing portion 26 is resiliently urged against the side wall of the housing of the first connector half 11. Once the front end of the reinforcing portion 26 has ridden over projection 19, the lateral movement of the leaf spring 13 is prevented, so that the leaf spring could hardly be removed from the first connector half 11. Therefore the projections 19 are formed at positions deviated from centers of the side walls of the housing of the first connector half 11.

The first and second recesses 17 and 18 formed in the housing of the first connector half 11 have fulcrum portions 17*a* and 18*a*, respectively. When the unlocking portion 23 of the leaf spring 13 is pushed inwardly as indicated by an arrow P, these portions serve as the fulcrum. Further the first recess 17 comprises a projection 17*b* which serves to prevent the intermediate portion 22 from being moved away from the fulcrum portion 17*a* upon pressing the unlocking portion 23.

When the second connector half 12 is inserted into the first connector half 11, the locking projection 16 formed on the housing of the second connector half is resiliently inserted into the locking aperture 21a formed in the end portion 21 of the leaf spring 13. In this manner, the coupling condition of the first and second connector halves 11 and 12 is locked by the leaf spring 13. During this locking condition, the reinforcing portion 26 serves to move the unlocking portion 23 of the leaf spring 13 in a direction opposite to the direction P, and thus the engagement of the locking projection 16 and locking aperture 2 la is hardly released.

In order to release the locking condition, the unlocking portion 23 of the leaf spring 13 is pushed inwardly against the resilient forces caused by the bent portion 25 and reinforcing portion 26. Then, the intermediate portion 22 of the leaf spring 13 is swung about the fulcrum portion 17*a* and the end portion 21 is moved away from the housing of the second connector half 12. In this manner, the locking projection 16 is removed from the locking aperture 21*a* and the locking condition can be released positively. Then, the second connector half 12 can be removed from the first connector half 11.

As explained above, in the connector locking device for detachably coupling the first and second connector halves 11 and 12 according to the invention, the reinforcing portion 26 of the leaf spring 13 can increase the mechanical force of the unlocking portion 23 and bent portion 25, and therefore the coupling condition of the first and second connector halves can be positively locked and any accidental release of the coupling can be avoided. Further, When the locking condition is released, the reinforcing portion 26 also serves to increase the resilient force of the leaf spring 13, and thus the locking aperture 21*a* can be positively removed from the locking projection 16. Moreover, if the locking projection 16 is not completely inserted into the locking aperture 21*a*, the first connector half 11 is resiliently expelled from the second connector half 12, so that incomplete coupling can be easily checked.

What is claimed is:

1. A device for detachably coupling first and second connector halves of an electric connector comprising a leaf spring having:

a fitting portion provided at a first end of said leaf spring, said fitting portion being secured to said first connector half, a locking aperture provided at a second end of said leaf spring, said locking aperture being engaged with a locking projection formed on said second connector half to couple said first and second connector halves with each other in a locking condition by means of said leaf spring, a bent portion formed adjacent to said fitting portion, an unlocking portion termed adjacent to said bent portion, an intermediate portion formed between said locking aperture and said unlocking portion, said intermediate portion being urged against a fulcrum formed on said first connector half, and a reinforcing portion having a first end connected to a junction between said bent portion and said unlocking portion and a second end urged against a side wall of said first connector half, said reinforcing portion being formed such that a side edge of said reinforcing portion abuts a projection formed in a surface of said first connector half viewed in a direction perpendicular to said side wall thereof, whereby said leaf spring is formed such that when said unlocking portion is pressed toward said side wall of said first connector half, said leaf spring is resiliently deformed such that said locking aperture is removed from said locking projection to release said locking condition of said first and second connector halves.

2. A device according to claim 1, wherein a front end of said second end of said leaf spring is bent in a direction away from said second connector half such that said front end of said second end can easily ride over said locking projection.

3. A device according to claim 1, wherein a front end of said second end of said reinforcing portion of said leaf spring is bent in a direction away from said first connector half.

4. A device according to claim 1, wherein said fitting portion of said leaf spring is bent substantially at a right angle such that said fitting portion is inserted into an L-shaped recess formed in said side wall of said first connector half and said intermediate portion and second end of said leaf spring have a structure permitting insertion thereof into a substantially linear recess of said first connector half.

5. A device according to claim 1, wherein said intermediate portion, unlocking portion, fitting portion and reinforcing portion of said leaf spring have ribs formed integrally therewith.

* * * * *